United States Patent [19]

Koepke

[11] 3,935,784

[45] Feb. 3, 1976

[54] DOUBLE TOUCH KEY FOR MUSICAL INSTRUMENTS

[75] Inventor: Donald Bernard Koepke, Franklin Park, Ill.

[73] Assignee: Warwick Electronics Inc., Chicago, Ill.

[22] Filed: Apr. 25, 1975

[21] Appl. No.: 571,532

[52] U.S. Cl. ..... 84/435; 84/DIG. 7

[51] Int. Cl.[2] ..... G10C 3/12

[58] Field of Search ..... 84/423, 433–435, 84/439, 440, DIG. 7

[56] References Cited

UNITED STATES PATENTS

| | | | |
|---|---|---|---|
| 1,948,996 | 2/1934 | Toulon | 84/423 UX |
| 3,175,451 | 3/1965 | Klann | 84/433 |
| 3,845,683 | 11/1974 | Lehmann | 84/433 X |

*Primary Examiner*—Stephen J. Tomsky
*Assistant Examiner*—John F. Gonzales
*Attorney, Agent, or Firm*—Wegner, Stellman, McCord, Wiles & Wood

[57] ABSTRACT

A double touch key for use with musical instruments and the like wherein a key lever is selectively supported on a plurality of pivots and is automatically transferred from one pivot to another as a function of the amount of depression of the key so as to provide a double touch action. A spring may be utilized to control the action of the key in each of the different pivotal modes. A difference in the feel of the key is automatically effected by the transfer of the pivot point.

19 Claims, 5 Drawing Figures

DOUBLE TOUCH KEY FOR MUSICAL INSTRUMENTS

BACKGROUND OF THE INVENTION

1. Field of the Invention

This invention relates to musical instrument keys and in particular to double touch keys.

2. Description of the Prior Art

In U.S. Pat. No. 3,175,451 of Paul A. Klann, a double touch key for a musical instrument is disclosed wherein the key lever pivots about a preselected pivot. The key lever may be pivoted beyond a first stop position against the action of a spring to make electrical contacts actuated thereby.

In U.S. Pat. No. 3,845,683 of Alfred H. Lehmann, a double touch key is disclosed wherein movement of the key is limited by engagement with a flexible stop permitting continued movement beyond the initial stop position to permit additional electrical contacts to be made for providing additional functions in the instrument. The key is pivoted on a single pivot means.

Lyle B. Muzzall, Jr., in U.S. Pat. No. 3,196,707, discloses a switch actuating mechanism utilizing a pivotal operator wherein the pivot point may be shifted by suitable control means.

SUMMARY OF THE INVENTION

The present invention comprehends an improved double touch key structure wherein a key lever for use in musical instruments and the like is pivotally mounted with respect to a plurality of pivot means whereby the key is firstly pivoted about a first of the pivot means until it reaches a first preselected position and is then pivoted about a second of the pivot means upon further depression of the key beyond the first preselected position.

The invention comprehends the provision of two or more such sequentially related pivot supports to provide two or more different touches wherein each of the sequential steps provides a different feel to the user. In the illustrated embodiment, the different feel is obtained by utilization of different moment arms as a result of the different positions of the pivot means relative to the operating portion of the key to be engaged by the user's fingers.

A definite change in the pivoting force required occurs at the transfer between the successive pivot arrangements so as to provide a detent-type feel.

A single spring may be utilized for biasing the key to a rest position which spring is operative over the entire pivotal range of the key.

As a substantial change in the moment arm occurs at the transfer point, high tolerances in the arrangement of contacts and the like to be actuated by the key is permitted. As the key structure is extremely simple and economical of construction and the use thereof permits simplified and economical switching means in association therewith, the invention provides a substantial improvement in musical instruments such as electronic organs and the like.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3, 4, 5:
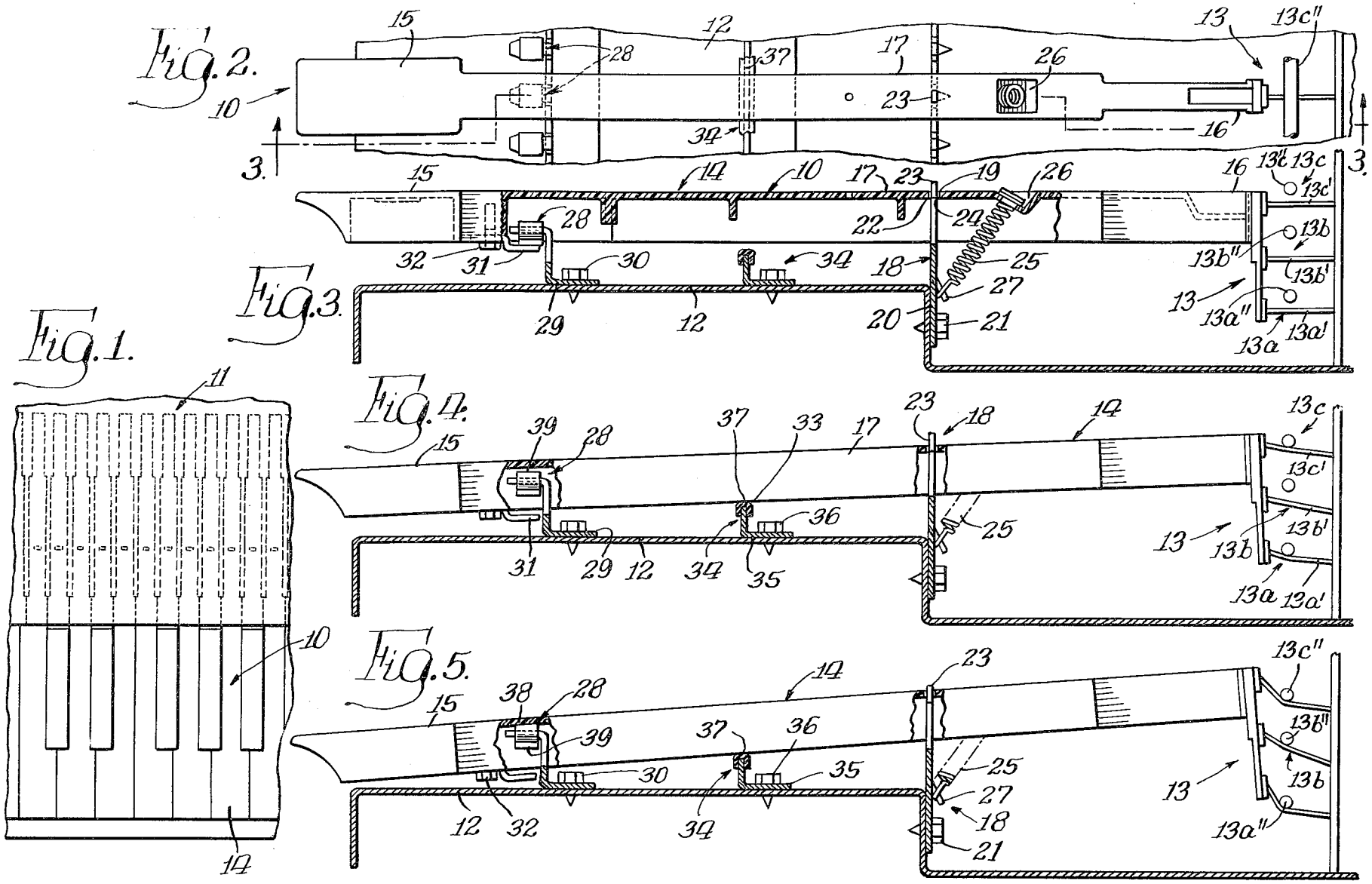
FIG. 1 is a fragmentary plan view of a keyboard having key structures embodying the invention.
FIG. 2 is a fragmentary plan view illustrating a single key structure thereof.
FIG. 3 is a vertical section taken substantially along the line 3—3 of FIG. 2, with the key in a rest position.
FIG. 4 is a vertical section similar to that of FIG. 3 but with the key in a first preselected depressed position.
FIG. 5 is a vertical section similar to that of FIG. 3 but with the key in a second preselected fully depressed position.

In the exemplary embodiment of the invention as disclosed in the drawing, a key structure generally designated 10 is shown for use in a musical instrument keyboard generally designated 11, such as the keyboard of an electronic organ or the like. The key structure of the present invention is adapted to provide a plurality of successive different touches and in the illustrated embodiment, provides a double touch action wherein the key may be selectively repositioned from a rest position, as shown in FIG. 3, to a first preselected depressed position, as shown in FIG. 4, and a second preselected depressed position, as shown in FIG. 5, with a difference in the feel of the key being effected relative to the depression from the rest to the first preselected position and the further depression from the first depressed to the second depressed position.

More specifically, as shown in FIG. 3, key structure 10 may be carried on a suitable frame 12 of the keyboard for operation of electrical switch means generally designated 13 including first contacts 13*a*, second contacts 13*b* and third contacts 13*c*.

Key structure 10 includes a lever key 14 defining a first end 15, a second, opposite end 16, and an intermediate portion 17. First end 15 defines the operating portion of the key adapted to be depressed by the user in the playing of the musical instrument. The opposite end 16, herein comprising the rear end of the key, carries suitable moving contacts of the switches 13*a*′, 13*b*′ and 13*c*′ for selective engagement with the fixed contacts thereof 13*a*″, 13*b*″ and 13*c*″.

Key 10 is pivotally mounted to frame 12 by a first pivot means 18 engaging the intermediate portion 17 at a first pivot portion 19. Pivot means 18 herein comprises a flat support 20 which may be secured to the frame by suitable means such as screw 21 to upstand therefrom. At its upper end, the pivot support defines an upwardly facing pivot shoulder 22 and a small projection 23 extending upwardly from shoulder 22 and through an aperture 24 in the key.

Thus, key portion 19 is pivotally supported on shoulder 22 to swing in a counterclockwise direction as a result of a depression of key end 15 by the user. The key is biased to the rest position of FIG. 3 by suitable spring means, herein illustratively comprising a coil spring 25 connected to a portion 26 of the key rearwardly of pivot portion 19 and to a struck tab 27 on the pivot support 20. The key is limited in the clockwise movement thereof urged by spring 25 by a stop 28 carried on a bracket 29 secured to frame 12 by suitable means, such as screw 30, and positioned to be engaged in the rest position by a shoulder element 31 secured to the key such as by a screw 32.

The extension of projection 23 through aperture 24 prevents longitudinal displacement of the key during the pivoting thereof on shoulder 22. When the key is depressed to the first preselected position of FIG. 4, a second portion 33 of the key intermediate portion 17 engages a second pivot means generally designated 34 comprising a pivot bracket 35 secured to the frame 12 as by screw 36. The pivot bracket may be provided with a resilient cap 37 for engagement by the key portion 33 for smooth transfer of the pivoting action from pivot means 18 to pivot means 34 as the result of a further depression of the key portion 15 downwardly to the second position of FIG. 5.

The transfer of the pivoting action from pivot means 18 to pivot means 34 effects a sudden change in the moment arm between the operating portion defined by the key end 15 and the respective pivot points. Thus, pivoting of the key about pivot means 18 may be effected with a relatively light touch as a result of the relatively large moment arm. A substantially heavier touch is required to effect the pivoting beyond the first preselected position of FIG. 4 as a result of the shorter moment arm between pivot means 34 and the operating end portion 15 in moving from the first preselected position of FIG. 4 to the second preselected position of FIG. 5. As further shown in FIG. 5, depression of key portion 15 is limited by the engagement of stop 28 with a wall portion 38 of the key to provide a positive limit to the depression.

Spring 25 functions to bias the key back to the rest position during the pivoting of the key about either of the pivot means 18 or 34 and cooperates with the shortened moment arm defined by pivot 34 to provide the increased touch requirement. As the change in the moment arm action is abrupt, the effect thereof is similar to that of a detent action, permitting facilitated double touch operation by the user.

In pivoting about pivot 34, the key is restrained against longitudinal displacement by projection 23, as illustrated in FIGS. 4 and 5.

Any suitable switching arrangement may be provided to be actuated by the key depression. In the illustrated embodiment, switches 13*a* and 13*c* are closed when the switch is brought to the first preselected position of FIG. 4, and switch 13*b* is additionally closed when the key is brought to the second position of FIG. 5. Switch means 13 may comprise a portion of a conventional printed circuit board.

Stop 28 may be provided with a resilient cap 39. Each of caps 37 and 39 illustratively may be formed of rubber and prevent noisy operation of the key structure.

The detentlike action of key structure 10 provides an improved feel for facilitated playing of a musical instrument by a musician. The use of the single spring 25 provides low cost and simplified construction while yet the novel pivot transfer structure provides a positive shifting of the fulcrum point and touch action in a double touch arrangement. As the pivot means 34 may be added to a conventional key construction utilizing a single pivot means 18, the present structure is adapted for facilitated modification of existing conventional musical instrument keyboards to provide an improved double touch action therein.

The foregoing disclosure of specific embodiments is illustrative of the broad inventive concepts comprehended by the invention.

Having described the invention, the embodiments of the invention in which an exclusive property or privilege is claimed are defined as follows:

1. Key structure for use with musical instruments and the like comprising:

a lever defining a key having opposite first and second ends and an intermediate portion;

first pivot means pivotally supporting said key at a first operating portion of said intermediate portion; and second pivot means pivotally supporting said key at a second portion of said intermediate portion, said key being pivotally supported by said first pivot means when said first end is depressed from a rest position to a first preselected depressed position and being pivotally supported by said second pivot means when said first end is depressed beyond said first preselected position.

2. The key structure of claim 1 wherein said second portion of said key intermediate portion is between said first portion thereof and said first end.

3. The key structure of claim 1 wherein means are provided for biasing said key to said rest position.

4. The key structure of claim 1 wherein a spring means is connected between said first pivot means and said key for biasing said key to said rest position.

5. The key structure of claim 1 wherein said second pivot means is disposed below the level of said first pivot means.

6. The key structure of claim 1 wherein switch means are carried by said second end of said key for selective operation as an incident of pivoting of said key to and beyond said first preselected position.

7. The key structure of claim 1 wherein means are provided for limiting the pivoting of said key about said second pivot means to a second preselected position.

8. Key structure for use with musical instruments and the like comprising:

a lever defining a key having opposite first and second ends and an intermediate portion;

first pivot means pivotally supporting said key at a first, operating portion of said intermediate portion;

second pivot means pivotally supporting said key at a second portion of said intermediate portion, said key being pivotally supported by said first pivot means when said first end is depressed from a rest position to a first preselected depressed position and being pivotally supported by said second pivot means when said first end is depressed beyond said first preselected position; and means for preventing longitudinal displacement of said key.

9. The key structure of claim 8 wherein said displacement preventing means comprises shoulder means carried by said first pivot means and cooperating shoulder means on said key.

10. The key structure of claim 8 wherein said displacement preventing means comprises an aperture in said key and projection means carried by said first pivot means and extending into said aperture.

11. The key structure of claim 8 wherein said displacement preventing means comprises an aperture in said key and projection means carried by said first pivot means and extending through said aperture.

12. The key structure of claim 8 wherein said second pivot means comprises an upstanding pivot element disposed to be engaged by said second portion of the key intermediate portion when the key is at said first preselected depressed position.

13. The key structure of claim 8 wherein spring means are provided for maintaining said key in operative association with said displacement preventing means.

14. The key structure of claim 8 wherein spring means are provided for maintaining said key in operative association with said displacement preventing means and biasing said key to said rest position.

15. The key structure of claim 8 wherein spring means are provided for maintaining said key in operative association with said displacement preventing means, said spring means being connected to said first pivot means.

16. Key structure for use with musical instruments and the like comprising:

a lever defining a key having an operating portion;

first pivot means pivotally supporting said key at a first portion thereof; and second pivot means pivotally supporting said key at a second portion thereof, said key being pivotally supported by said first pivot means when said operating portion of the key is depressed from a rest position to a first preselected depressed position and being pivotally supported by said second pivot means when said operating portion is depressed beyond said first preselected position.

17. The key structure of claim 16 wherein means are provided for constraining the key against transverse displacement relative to said pivot means.

18. The key structure of claim 16 wherein a single resilient means is provided for biasing the key to said rest position from all depressed positions thereof.

19. The key structure of claim 16 wherein electrical control means are provided in association with said key for selective operation as a function of the amount of depression of said key.

* * * * *